US006375289B1

(12) United States Patent
Yemini

(10) Patent No.: US 6,375,289 B1
(45) Date of Patent: Apr. 23, 2002

(54) ORGANIZING CABINET WITH SORTING TRAY

(75) Inventor: Zvi Yemini, Ramat-Aviv (IL)

(73) Assignee: Zag Industries, Ltd., Rosh Ha'ayin (IL)

( * ) Notice: Subject to any disclaimer, the term of this patent is extended or adjusted under 35 U.S.C. 154(b) by 0 days.

(21) Appl. No.: 09/635,555

(22) Filed: Aug. 10, 2000

(51) Int. Cl.[7] ..... A47B 81/00
(52) U.S. Cl. ..... 312/290; 312/902
(58) Field of Search ..... 312/280, 290, 312/902, 210.5, 212, 293.2, 327, 231; 206/373, 338

(56) References Cited

U.S. PATENT DOCUMENTS 2,629,644 A * 2/1953 Heys ..... 312/290 X
5,762,411 A * 6/1998 Yemini ..... 312/290

FOREIGN PATENT DOCUMENTS

FR 23165 * 10/1921 ..... 312/902

* cited by examiner

*Primary Examiner*—James O. Hansen
(74) *Attorney, Agent, or Firm*—Pillsbury Winthrop LLP

(57) ABSTRACT

An organizing cabinet for storing relatively small, loose items in sorted fashion configured to facilitate sorting and storing of the items. The organizing cabinet features a cabinet holding a plurality of storage bins and a sorting plate disposed at an upper portion of the cabinet. The sorting plate is pivotally connected to the cabinet at a pivot axis. The sorting plate has a flat sorting surface and a retaining wall extending along the sorting surface. The retaining wall extends generally parallel to or aligned with the pivot axis and has a dispensing port formed through which sorted items are poured either directly into a selected receptacle or into a user's hand simply by pivoting the sorting plate upwardly about the pivot axis.

18 Claims, 5 Drawing Sheets

ORGANIZING CABINET WITH SORTING TRAY

FIELD OF THE INVENTION

The invention relates generally to organizers and, more specifically, to organizers that facilitate sorting and storing relatively small, loose items.

BACKGROUND OF THE INVENTION

Generally, organizers for storing relatively small, loose items such as nuts, bolts, screws, etc. consist of a cabinet housing a number of drawer-type storage bins. When placing items into the storage bins of an organizer of this type, a user sometimes needs to sort the items before they are placed in the bins, for example, if the various items to be stored are intermingled.

SUMMARY OF THE INVENTION

The invention provides an organizing cabinet for storing relatively small, loose items in sorted fashion which is configured to facilitate sorting and storing of the items. The organizing cabinet features a cabinet housing a number of storage bins and a sorting plate disposed at an upper portion of the cabinet. The sorting plate is pivotally connected to the cabinet at a pivot axis located along an upper edge of the cabinet. The sorting plate has a flat sorting surface and a retaining wall extending along the sorting surface, generally along the pivot axis. A dispensing port is formed in the retaining wall. Relatively small, loose items which have been sorted on the sorting surface can then be poured into a receptacle positioned below the dispensing port by pivoting the sorting plate upwardly about the pivot axis such that the items pass through the dispensing port and drop into the receptacle.

Other objects, features, and advantages of the present invention will become apparent from the following detailed description, the accompanying drawings, and the appended claims.

DETAILED DESCRIPTION OF PREFERRED EMBODIMENTS

Figure 1:
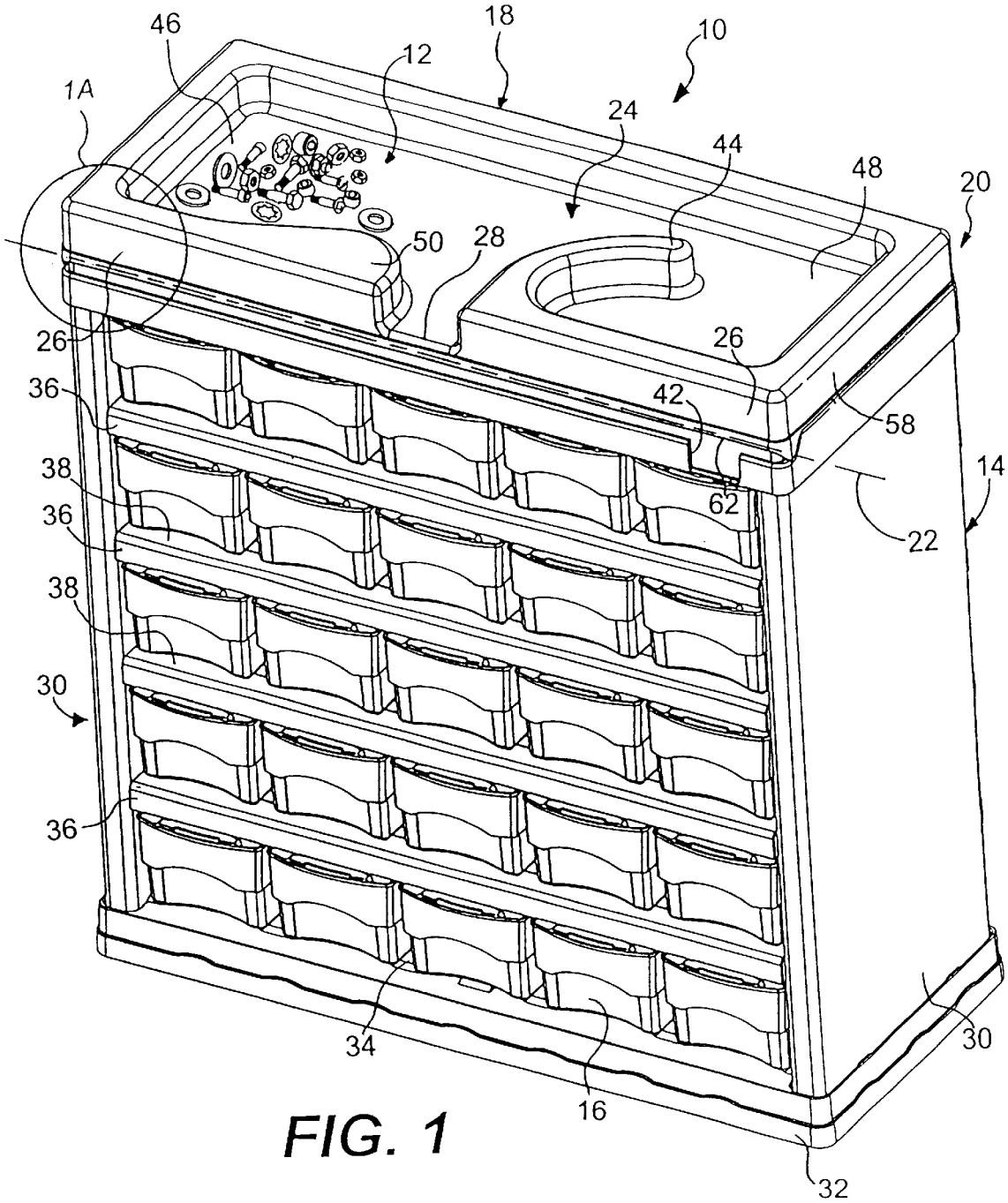
FIG. 1 is a perspective view of an organizing cabinet according to the present invention.
Figure 1A:
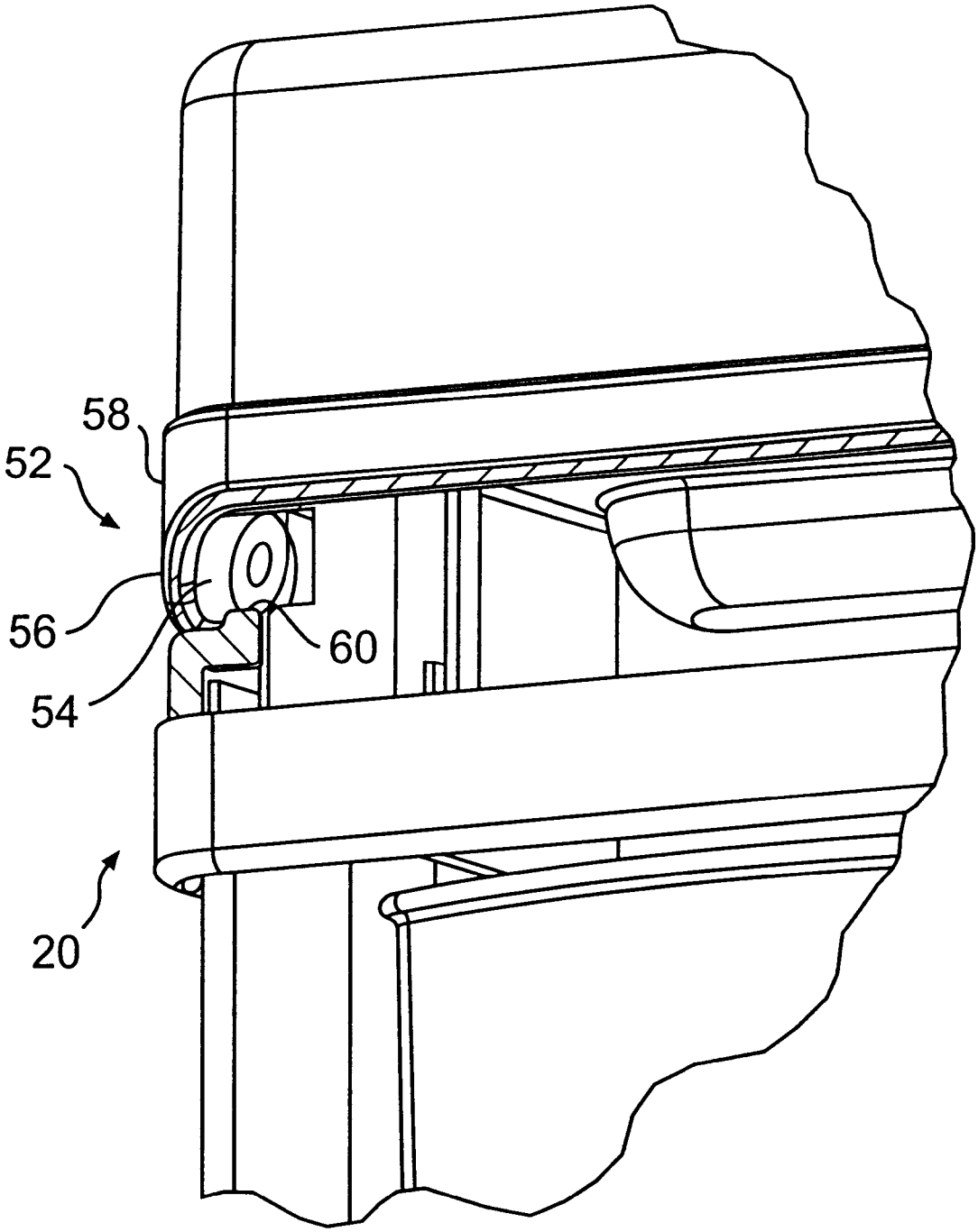
FIG. 1A is a break-away view showing internal details in the area marked 1A in FIG. 1.

Referring now more particularly to the drawings, FIGS. 1, 1A, 2, 2A, and 3 illustrate an organizing cabinet according to the invention, generally indicated at 10, for sorting and storing small, loose items 12. The organizing cabinet 10 includes a cabinet 14 housing a number of drawer-type storage bins 16 and a sorting plate, generally indicated at 18, attached to an upper, frame portion 20 of the cabinet 14. As described in greater detail below, the sorting plate 18 is pivotally connected to the cabinet 14 by a pair of hinge structures 52 and pivots about a pivot axis 22 located along an upper edge of the upper frame portion 20. The sorting plate 18 has a flat sorting surface 24 and a retaining wall 26, which extends along the sorting surface 24. A dispensing port 28 is formed in the retaining wall 26, and the sorted items 12 are poured through it when the sorting plate 18 is pivoted upwardly.

Figure 2:
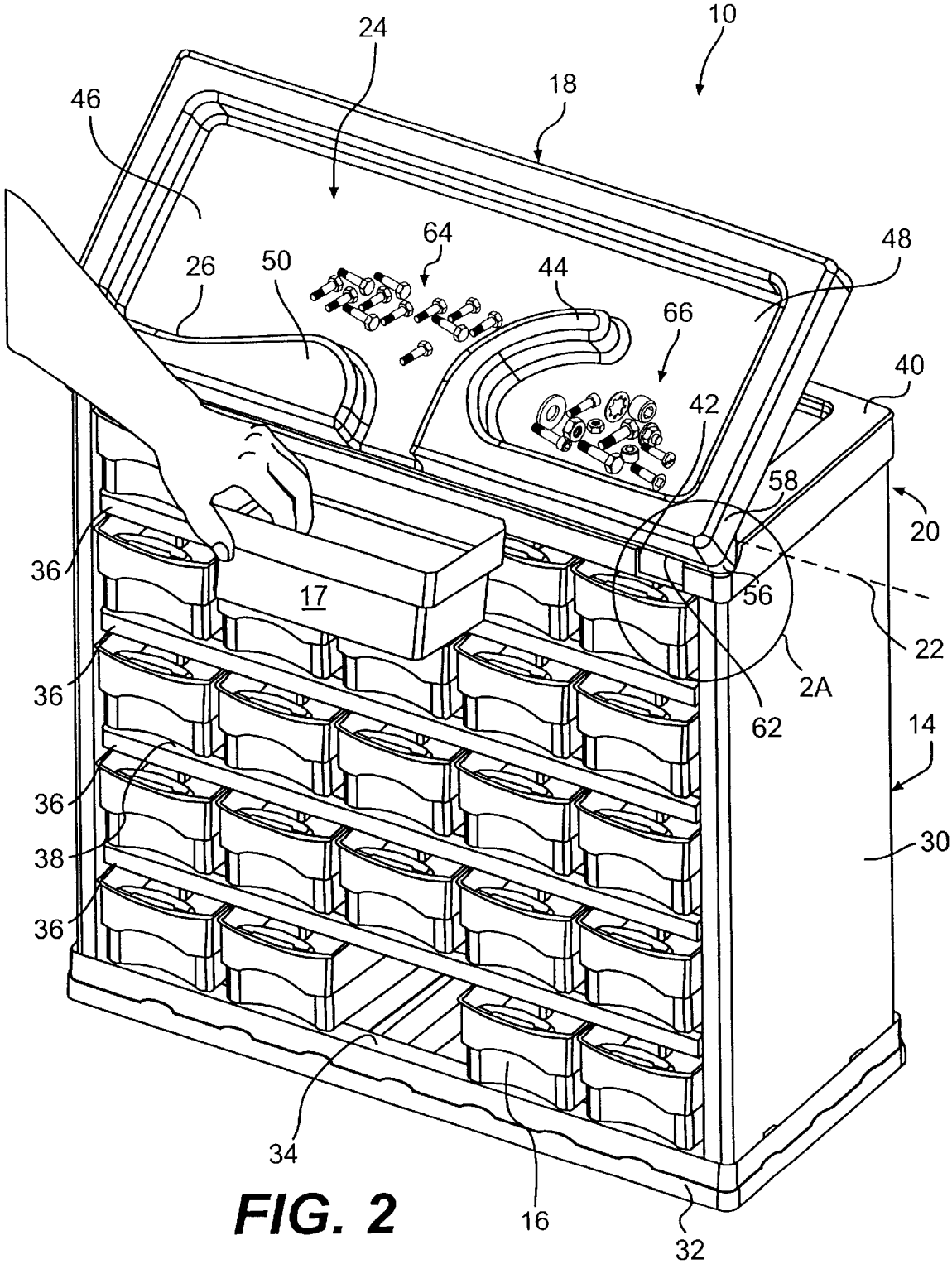
FIG. 2 is a perspective view of the organizing cabinet shown in FIG. 1, with the sorting plate pivoted relative to the cabinet to dispense items on the sorting plate into a storage bin held under the dispensing port.
Figure 2A:
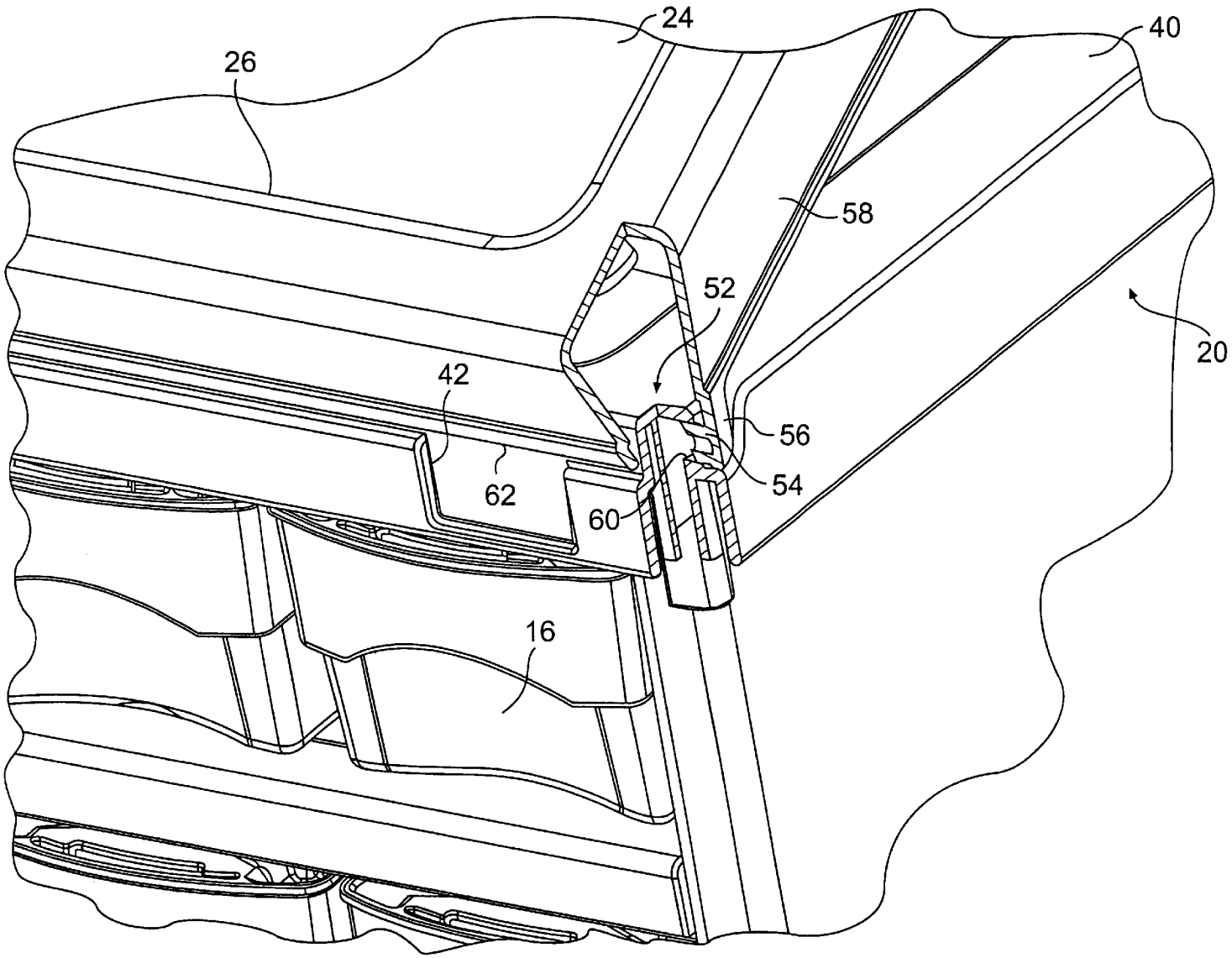
FIG. 2A is a break-away view showing internal details in the area marked 2A in FIG. 2.
Figure 3:
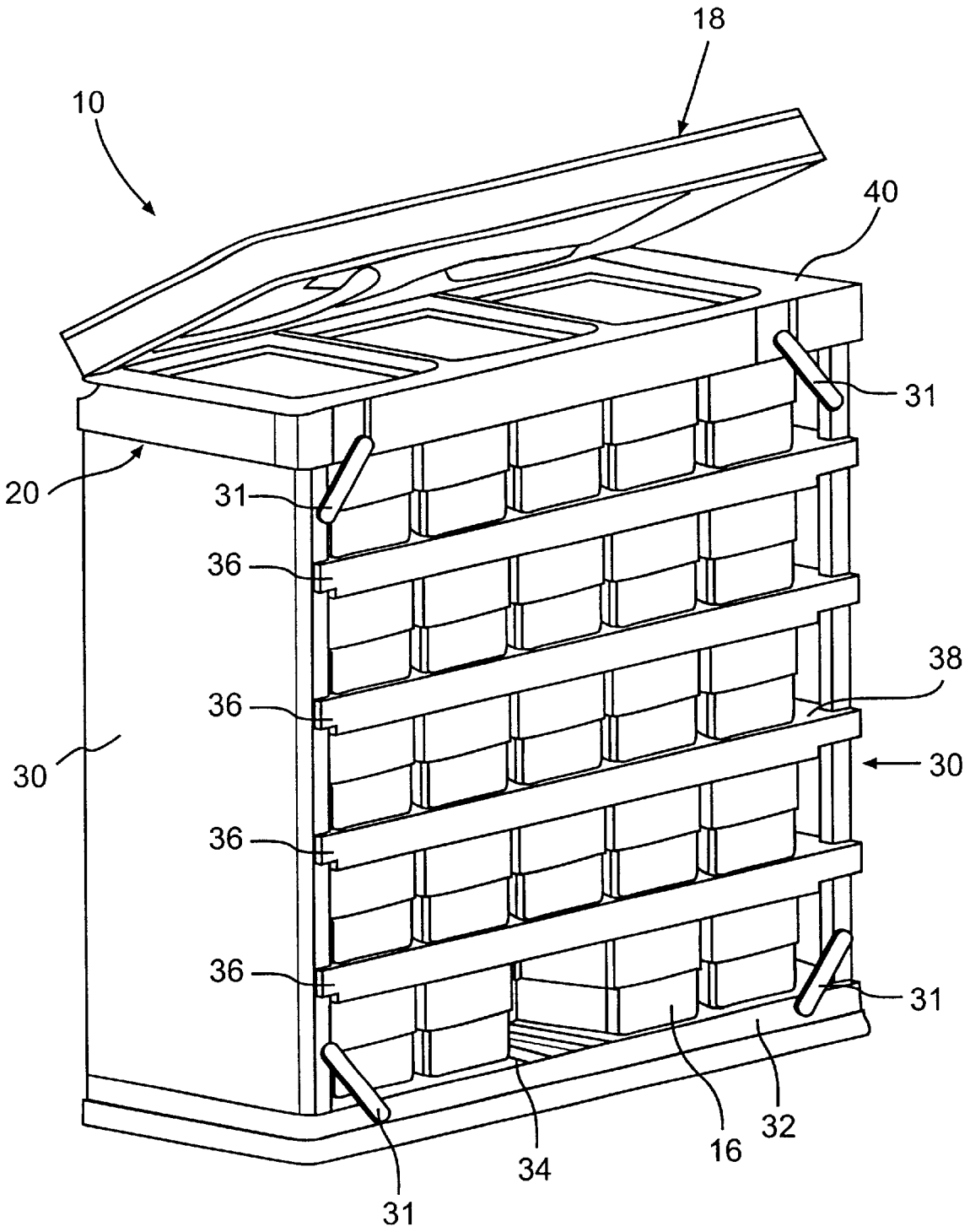
FIG. 3 is a rear view of the organizing cabinet shown in FIGS. 1 and 2.

The cabinet 14 has a pair of metallic side walls 30 formed from stamped sheet metal, which are braced by supports 31 as shown in FIG. 3. One pair of supports are connected between each side wall 30 and the upper frame portion 20, and the other pair of supports are connected between each side wall 30 and a molded plastic base portion 32. The molded plastic base portion 32 has an upper surface 34 at the bottom of the cabinet 14. Horizontal supporting shelves 36 extend between the side walls 30 of the cabinet 14 in vertically spaced relation, each having an upper surface 38. As illustrated in FIGS. 2 and 2A, the upper frame portion 20 of the cabinet 14 is preferably formed as a frame that extends along the perimeter of the cabinet 14, with the frame 20 having an upper surface 40. The frame 20 preferably has a slot or notch 42, and a plastic label or placard (e.g. with the name of a hardware store, etc.) can be inserted into the slot or notch 42. In general, the components of the cabinet 14 can be made from plastic or any other suitable material such as metal, wood, or other rugged material.

As shown in FIGS. 1 and 2, the storage bins 16 are arranged within the cabinet 14 in horizontal rows and vertical columns, with the storage bins 16 slidingly supported on the upper surfaces 34, 38 of the base portion 32 and supporting shelves 36, respectively. Alternatively, the cabinet 14 could be configured to house a number of storage bins 16 having different sizes. In such alternative configurations, the storage bins would not necessarily be arranged in precise horizontal rows and vertical columns.

Preferably, the storage bins 16 can be removed from the cabinet 14. That way, after being sorted, the items 12 can be poured (as described in more detail below) directly into a selected storage bin 17 by removing that storage bin from the cabinet 14, holding it under the dispensing port 28 as shown in FIG. 2, and pivoting the sorting plate 18 upwardly so that the items 12 are discharged through the dispensing port and into the selected storage bin 17.

With respect to the sorting plate 18, a retaining wall 26 extends from the sorting surface 24 so as to retain a portion of the items 12 which are not to be stored in a particular selected bin when the sorting plate 18 is pivoted upward. Preferably, the retaining wall 26 extends along the entire perimeter of the sorting plate 18, except for where the dispensing port 28 is formed. All that should be present for proper operation of the invention, however, is some sort of ridge-shaped retaining member extending along or generally aligned with the pivot axis 22 so as to retain the items 12 not being discharged when the sorting plate 18 is pivoted upwardly.

A retaining wall extension 44 extends from a portion of the retaining wall 26, generally adjacent to the dispensing port 28 and partially across the sorting surface 24 toward an opposite portion of the retaining wall 26. The retaining wall extension 44 generally separates the sorting surface 24 into a discharge region 46 and a retention region 48. Additionally, a guiding portion 50 of the retaining wall is formed in the discharge region 46. Guiding surfaces 45 and 51 of the retaining wall extension and the guiding portion 50, respectively, are configured to guide or "funnel" the desired items toward the dispensing port 28. The retention region 48 retains items 12 disposed therein when the sorting plate 18 is pivoted upwardly, whereas the discharge region 46, together with the guiding portion 50, permits items 12 disposed therein to be guided into the dispensing port 28 for discharge into a receptacle positioned below it. Alternatively, in a configuration not shown, the retaining wall extension 44 could extend completely across the sorting surface 24 to the opposite portion of the retaining wall 26 such that the retention region 48 is completely bounded and separated from the discharge region 46.

As noted above, the sorting cabinet 10 has hinge structures 52 which permit the sorting plate 18 to pivot with respect to the cabinet 14, about the axis 22. As shown in greater detail in FIGS. 1A and 2A, each hinge structure 52 consists of a cylindrical shaft member 54 extending from an associated extension member 56 extending from wall 58 of the sorting plate 18, and each shaft member 54 is supported in a journaling opening 60 formed in an outwardly facing surface of the frame portion 20. Thus, the cylindrical shaft members 54 form the pivot axis 22. (It should be noted that FIG. 2A shows a break-away view of the cylindrical shaft member 54 and its journaling opening 60. The journaling opening 60 is actually circular and completely surrounds the associated shaft member 54.) The shaft members 54 are positioned relative to the bottom, front edge 62 of the sorting plate 18 so as to allow the sorting plate 18 to pivot about the pivot axis 22 without obstruction.

The cylindrical shaft members 54 are inserted into the journaling openings 60 by a spring type deflection. For example, one shaft member 54 would be inserted into its journaling opening 60 and the extension member 56 carrying the other shaft member 54 would be flexed away from the frame portion 20 such that the associated shaft member 54 could be inserted into its journaling opening to pivotally attach the sorting tray 18 to the cabinet 14.

Alternatively, in a configuration not shown, the hinge structure could consist of a series of aligned journaling members extending from the sorting plate and the upper frame portion 20. A pin-type axle member would pass through the journaling members and be retained therein by suitable securing means.

Operation

The organizing cabinet of the invention is used as follows. A user places a number of small, loose, intermingled items 12 on the sorting surface 24, either in the discharge region 46 or the retention region 48. The items may be, for example, different sizes of nuts, bolts, screws, etc., or a variety of each. The user then counts out or sorts out a desired number of the specific items to be stored in the selected storage bin 17, thereby dividing the group of items 12 into first and second groups 64, 66 (FIG. 2), with the first group 64 disposed on the discharge region 46 of the sorting surface 24 and the second group 66 disposed on the retention region 48. The user may either place the original group of items in discharge region 46 and remove (e.g. slide) items not to be discharged into the selected receptacle to the retention region 48 or, alternatively, the user may place the original group of items in the retention region 48 and transfer the items to be stored in the selected receptacle over to the discharge region 46.

After the items are separated into the first and second groups 64, 66, the selected storage bin 17 is removed from the cabinet 14 and held below the discharge spout 28, as shown in FIG. 2. The user then pivots the sorting plate 18 upward relative to the cabinet 14 so as to discharge the first group of items 64 through the dispensing port 28 and directly into the selected storage bin 17. The second group of items 66 is automatically retained on the retention region 48 of the sorting surface 24. The selected storage bin 17 would then be replaced in the cabinet 14. Alternatively, the user could hold his or her hand under the dispensing port 28 and discharge the items into his or her hand, then manually place the items in the selected storage bin 17.

While the principles of the invention have been made clear in the illustrative embodiments set forth above, it will be apparent to those skilled in the art that various modifications may be made to the structure, arrangement, proportion, elements, materials, and components used in the practice of the invention. For example, the sorting plate could be provided as a retrofit for an existing organizing cabinet. In that case, the sorting plate 18 would be attached to its own individual support frame, and that support frame would rest on the upper surface of a pre-existing organizing cabinet. The sorting plate 18 would be pivotally attached to an upper portion of the support frame by hinge structures at a pivot axis located along an upper edge of the support frame.

In another contemplated embodiment, the sorting plate could be configured to slide laterally so as to move the dispensing port into position over any given desired storage bin 16. Such an embodiment could be constructed by, for example, providing a rail along the upper front edge of the cabinet 14 and mounting the sorting plate to that rail by means of sliding, pivoting clips. That way, the desired storage bin 16 (especially those positioned in the upper row of the cabinet 14) could be partially withdrawn from the cabinet 14 and the sorting plate could be slid along the rail to position the dispensing port into position over the desired storage bin 16, then the items could be dispensed directly into the storage bin without removing it completely from the cabinet. Thus, the foregoing preferred specific embodiments have been shown and described for the purpose of illustrating the functional and structural principles of this invention and are subject to change without departure from such principles. Therefore, this invention includes all modifications encompassed within the spirit and scope of the following claims.

I claim:

1. An organizer for storing relatively small, loose items in sorted fashion, said organizer configured to facilitate sorting and storing of said items, said organizer comprising:

a cabinet holding a plurality of storage bins; and a sorting plate disposed at an upper portion of said cabinet and being pivotally connected to said cabinet at a pivot axis, said sorting plate comprising a flat sorting surface and a retaining wall extending along said sorting surface, said retaining wall having a dispensing port formed therein;

said sorting plate being pivotable about said pivot axis, with said retaining wall being configured and disposed so as to retain items on the sorting surface when the sorting plate is pivoted about said pivot axis, such that relatively small, loose items placed on said sorting surface can be poured through said dispensing port and into a receptacle positioned below said dispensing port by pivoting said sorting plate upwardly about said pivot axis, with items not desired to be poured through said dispensing port and into said receptacle being retained on said sorting surface by means of said retaining wall.

2. The organizer of claim 1, wherein said storage bins are removable from said cabinet such that the items can be poured directly into a selected storage bin constituting said receptacle by removing said selected storage bin from said cabinet; holding said selected storage bin under said dispensing port; and pivoting said sorting plate upwardly about said pivot axis.

3. The organizer of claim 1, wherein said retaining wall has guiding surfaces configured to funnel or guide the items toward said dispensing port.

4. The organizer of claim 1, wherein said sorting plate is supported on an upper surface of said cabinet when not pivoted.

5. The organizer of claim 1, wherein said sorting plate forms an upper wall of said cabinet when not pivoted.

6. The organizer of claim 1, wherein said sorting plate comprises a retrofit attachment to said cabinet.

7. The organizer of claim 1, wherein, except for said dispensing port, said retaining wall extends along the entire perimeter of said sorting plate.

8. The organizer of claim 1, wherein said sorting surface has a discharge region and a retention region that is at least partially separated from said discharge region, said retention region being configured to retain items disposed thereon when said sorting plate is pivoted upwardly and said discharge region being configured to permit items disposed thereon to be guided to said dispensing port for discharge into the receptacle positioned below said dispensing port.

9. The organizer of claim 8, wherein said sorting plate has a retaining wall extension extending from a portion of said retaining wall in the vicinity of said dispensing port at least partially across said sorting surface toward an opposite portion of said retaining wall to define said retention region and said discharge region.

10. The organizer of claim 9, wherein said retaining wall extension extends completely across said sorting surface to said opposite portion such that said retention region is completely bounded and separated from said discharge region.

11. The organizer of claim 1, wherein said sorting plate is connected to said cabinet by means of hinge structures comprising shaft members extending from one of said sorting plate and said cabinet and journaling openings formed in the other of said sorting plate and said cabinet, said shaft members fitting in and rotating in said journaling openings.

12. A sorting plate assembly for retrofitting an organizer for storing relatively small, loose items, which organizer comprises an organizer cabinet holding a plurality of drawer-type storage bins, said sorting plate assembly comprising:

a support frame configured to rest on an upper surface of the organizer cabinet; and a sorting plate disposed at an upper portion of said support frame and being pivotally connected to said support frame at a pivot axis, said sorting plate comprising a flat sorting surface and a retaining wall extending along said sorting surface, said retaining wall having a dispensing port formed therein;

said sorting plate being pivotable about said pivot axis such that relatively small, loose items placed on said sorting surface can be poured through said dispensing port and into a receptacle positioned below said dispensing port by pivoting said sorting plate upwardly about said pivot axis.

13. The sorting plate assembly of claims 12, wherein, except for said dispensing port, said retaining wall extends along the entire perimeter of said sorting plate.

14. The sorting plate assembly of claim 12, wherein said retaining wall has guiding surfaces configured to funnel or guide the items toward said dispensing port.

15. The sorting plate assembly of claim 12, wherein said sorting surface has a discharge region and a retention region that is at least partially separated from said discharge region, said retention region being configured to retain items disposed thereon when said sorting plate is pivoted upwardly and said discharge region being configured to permit items disposed thereon to be guided to said dispensing port for discharge into the receptacle positioned below said dispensing port.

16. The sorting plate assembly of claim 15, wherein said sorting plate has a retaining wall extension extending from a portion of said retaining wall in the vicinity of said dispensing port at least partially across said sorting surface toward an opposite portion of said retaining wall to define said retention region and said discharge region.

17. The sorting plate assembly of claim 16, wherein said retaining wall extension extends completely across said sorting surface to said opposite portion such that said retention region is completely bounded and separated from said discharge region.

18. The sorting plate assembly of claim 12, wherein said sorting plate is connected to said frame by means of hinge structures comprising shaft members extending from one of said sorting plate and said frame and journaling openings formed in the other of said sorting plate and said frame, said shaft members fitting in and rotating in said journaling openings.

* * * * *